US005483316A

United States Patent [19]

Zwettler

[11] Patent Number: 5,483,316

[45] Date of Patent: Jan. 9, 1996

[54] FILM CHIP TRANSPORT ASSEMBLY FOR FILM PROCESSING ASSEMBLY

[75] Inventor: Ernest Zwettler, Temecula, Calif.

[73] Assignee: Air Techniques, Inc., Hicksville, N.Y.

[21] Appl. No.: 272,139

[22] Filed: Jul. 8, 1994

[51] Int. Cl.[6] ..... G03D 3/08; G03D 3/04

[52] U.S. Cl. ..... 354/320; 354/328

[58] Field of Search ..... 354/319–323, 354/339, 316, 324, 328; 134/64 P, 64 R, 122 P, 122 R, 75

[56] References Cited

U.S. PATENT DOCUMENTS 3,712,206 1/1973 Schmidt ..... 354/321

3,882,525 5/1975 Zwettler ..... 354/339 X 4,422,748 12/1983 Everett et al. ..... 354/316

4,760,417 7/1988 Zwettler et al. ..... 354/321

5,241,339 8/1993 Maroney ..... 354/321 X

*Primary Examiner*—D. Rutledge

*Attorney, Agent, or Firm*—Louis E. Marn

[57] ABSTRACT

There is disclosed a film transport assembly for a film processing assembly comprised of a plurality of endless belts having film contact pins for positive processing of a film chip through portions of an automatic X-ray film processor assembly.

3 Claims, 4 Drawing Sheets

FILM CHIP TRANSPORT ASSEMBLY FOR FILM PROCESSING ASSEMBLY

BACKGROUND OF THE INVENTION

1. Field of the Invention

This invention relates to a film processing assembly, and more particularly, to a film chip transport assembly for a film processor automatically processing X-ray film chips.

2. Description of the Prior Art

In U.S. Pat. No. 3,882,525 to Zwettler, there is disclosed a processor for developing batches of dental X-ray film chips including a film transport unit comprised of a pair of laterally-disposed, vertically-spaced, parallel walls forming a continuously curved channel with three loops. The downwardly-extending curved portions of the loops respectively extend into tanks in the development compartment of the processor. A lower lifter is mounted to rotate in each downwardly-extending curved portion of the continuous channel, and an upper lifter is mounted to rotate in each upwardly extending curved portion of the continuous channel. The inside surfaces of the pair of walls are provided with opposing V-grooves which form a path coaxially disposed to the channel for engaging the opposite edges of vertically-disposed film chips. Each film chip is permitted to drop by gravity along the downwardly-extending portions of its path and is lifted by the lower and upper rotating lifters along the upwardly-extending portions of its path.

In U.S. Pat. No. 4,760,417 also to Zwettler, there is disclosed an improved portable roll film processor for automatically processing roll film wherein a removable film drive module is provided for moving the film through tanks containing chemical processing liquids. The film drive module defines an essentially serpentine path for the film including successive "U"-shaped sections depending from a common frame member. Each of the "U"-shaped sections extends into a different tank and includes a down path leg for carrying the film into the tank and an up path leg for carrying the film out of the tank. All moving parts required to move the film are located above the liquids to minimize maintenance problems.

In U.S. Pat. No. 5,241,339 to Maroney and assigned to the same assignee as the present invention, there is disclosed an automatic X-ray film processor assembly comprised of a drive assembly for the film transport unit including intermittently-operated lower lifters for passing the film chips from each tank through succeeding processing units, thereby ensuring more uniform processing time, as well as permitting facile changes in processing times.

While such film processors effectively developed X-ray film chips, the film drive assemblies resulted in variable processing times as well as varying processing conditions, such assemblies rely upon carefully coordinated arm movements. Additionally, the drive assemblies are costly to fabricate.

OBJECTS OF THE PRESENT INVENTION

An object of the present invention is to provide a film transport assembly for an automatic film processor of simplified construction.

Another object of the present invention is to provide a film drive assembly for an automatic film processor permitting for more effective processing.

Yet another object of the present invention is to provide a film drive assembly for an automatic film processor including means for maintaining solution concentrations.

Still another object of the present invention is to provide a film drive assembly for an automatic film processor permitting increased immersion in the solutions.

SUMMARY OF THE INVENTION

These and other objects of the present invention are achieved by a film transport assembly for a film processing assembly comprised of a plurality of endless belts having film contact pins for positive processing of a film chip through portions of an automatic X-ray film processor assembly.

BRIEF DESCRIPTION OF THE DRAWINGS

Further objects and advantages of the present invention will become apparent from the following detailed description when taken with the accompanying drawings, wherein.

DETAILED DESCRIPTION OF THE PRESENT INVENTION

Prior to a detailed description of the present invention, reference is made to the film chip processor disclosed in the aforementioned pending application hereby incorporated by reference.

Figure 3:
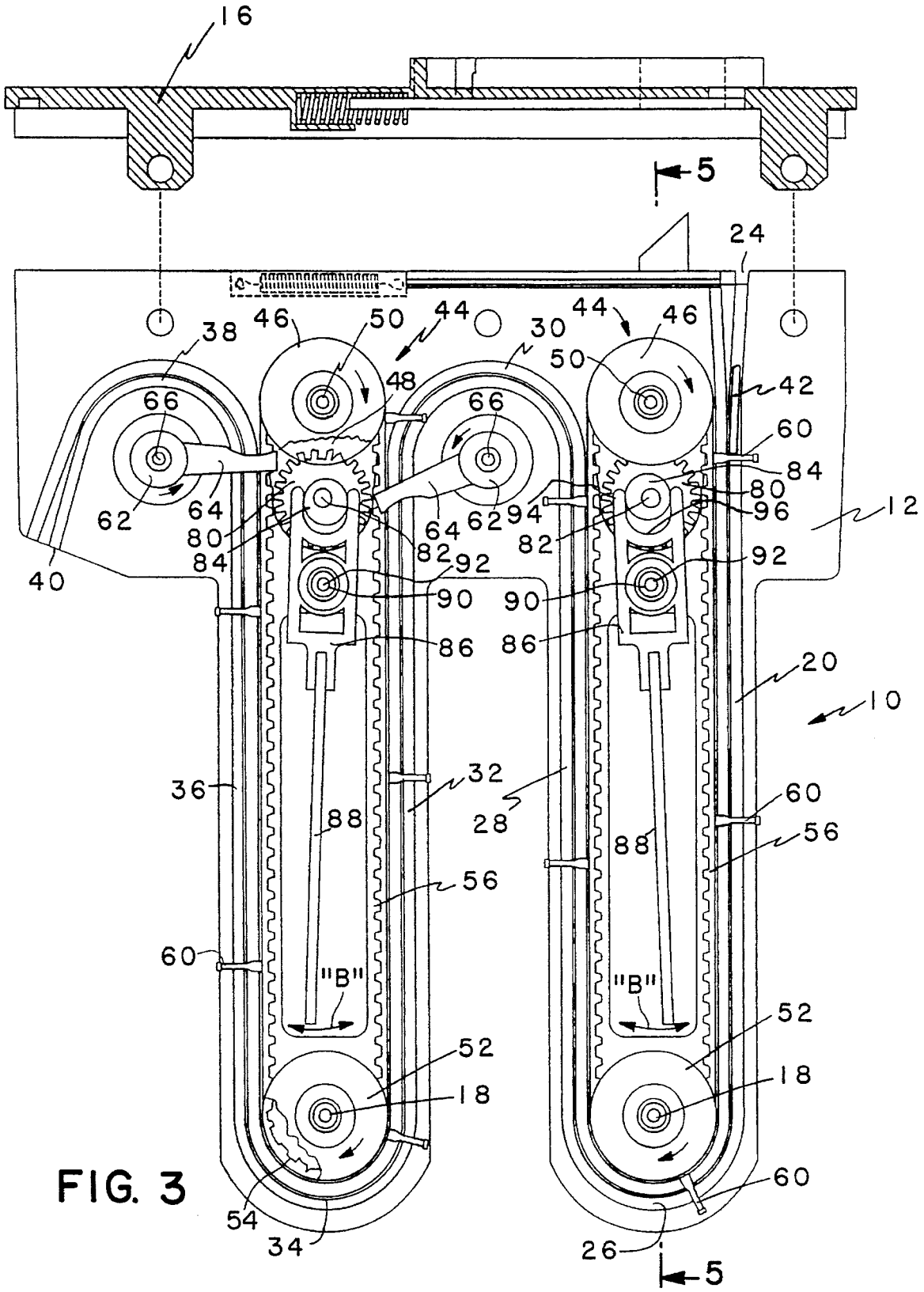
FIG. 3 is a cross-sectional view of the film transport assembly of the present invention taken along the lines 3–3 of FIG. 4.
Figure 4:
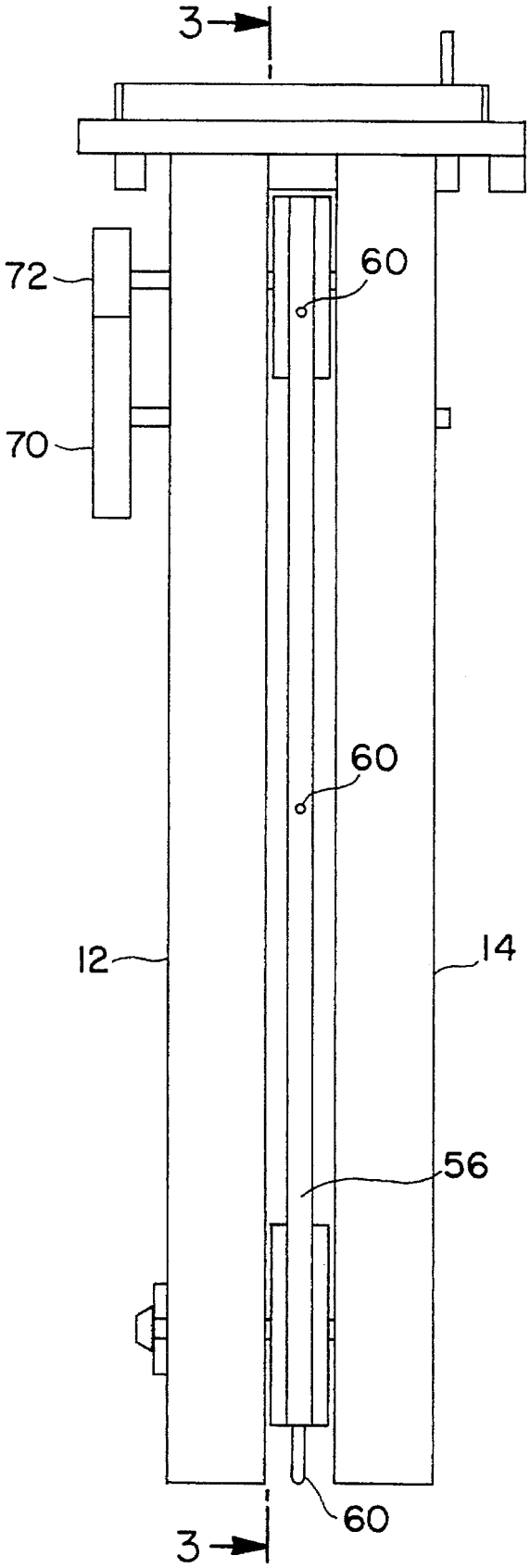
FIG. 4 is an end view of the film processor of the present invention.
Figure 5:
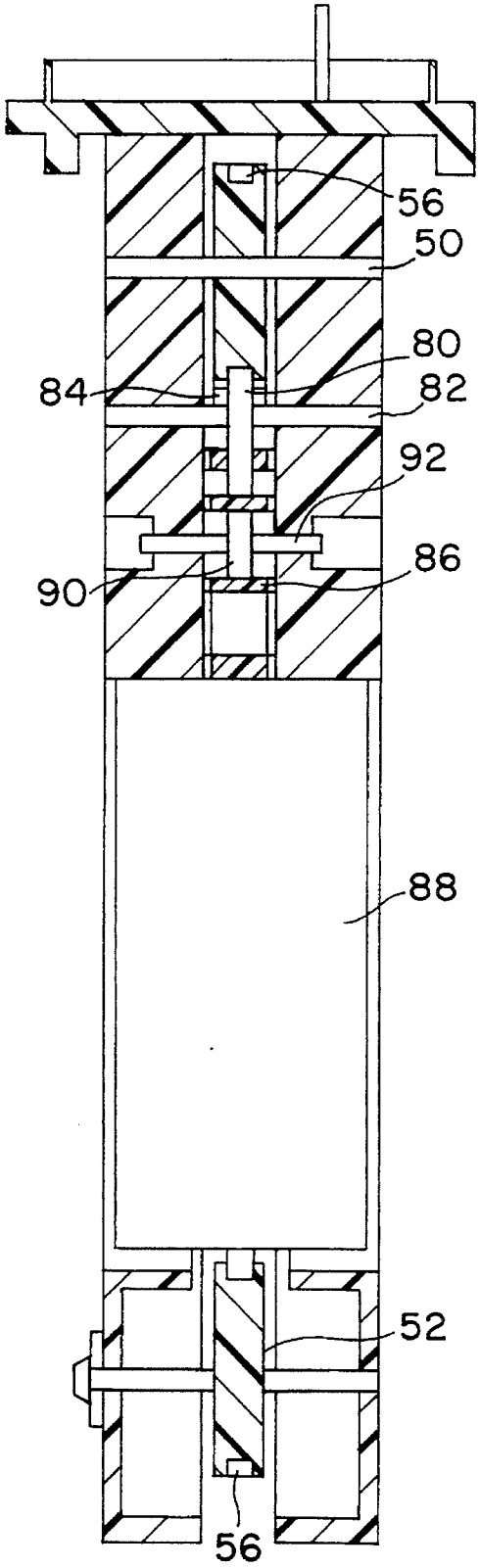
FIG. 5 is a cross-sectional view taken along the lines 5—5 of FIG. 1.

Referring now more particularly to the drawings, there is illustrated a film chip transport assembly, generally indicated as 10, of the present invention comprised of a right side member 12 and a left side member mounted to one another in spaced-apart relationship via a top member 16 and lower shaft member 18. Each of the side members 12 and 14 is formed with a groove 20 and 22, respectively, defining a channel for a film chip (FC) disposed laterally with respect to the channel referring specifically to FIG. 3. The channel formed by the grooves 20 and 22 comprises a vertical entrance passage 24 leading down to a first lower semicircular portion 26 which curves up to a vertical portion 28 leading to a first upper semicircular portion 30. The upper semicircular portion 30 then curves down to a vertical portion 32 leading down to a second lower semicircular portion 34 which curves up to a vertical portion 36 leading into an upper quarter circular portion 38 leading into a horizontal exit passage 40.

The opposing grooves 20 and 22 engage opposite edges of small flexible film chips 42 (FIG. 3—one shown) to be advanced through the film chip transport assembly 10. Each paired vertical portions (20/28; 32/36) are provided with transport assemblies, generally indicated 44, referring particularly to FIG. 3, comprised of an upper roller member 46 including radially-formed gear surface 48 mounted for rotation on an upper shaft 50 and a lower roller member 52, including a radially-formed gearing surface 54 journalled for rotation in the shaft member 18. Positioned about the upper and lower roller members 46 and 52 is a flexible endless belt member 56 having an inner surface formed with inwardly-extending teeth 58 for engaging the gear surfaces 48 and 54 of the upper and lower roller members 46 and 52, respectively. Positioned about the endless belt member 56 are a plurality of pins 60 extending outwardly past the channel formed by the grooves 20 and 22 for positive engagement with a film chip FC, as more fully hereinafter described.

An upper lifter member 62 having a single radially-extending arm member 64 is respectively mounted to rotate about the axes of their respective shafts 66 disposed at the center of the upper semicircular portions 30 and the quarter circular portion 38 of the last section of the channel. The upper lifters 62 cooperate to raise film chips FC along the rising portions of the grooves 20 and 22 forming the channel in the upper portions 30 and 32 and to transport such film chip to the succeeding portions of the channel.

Figure 1:
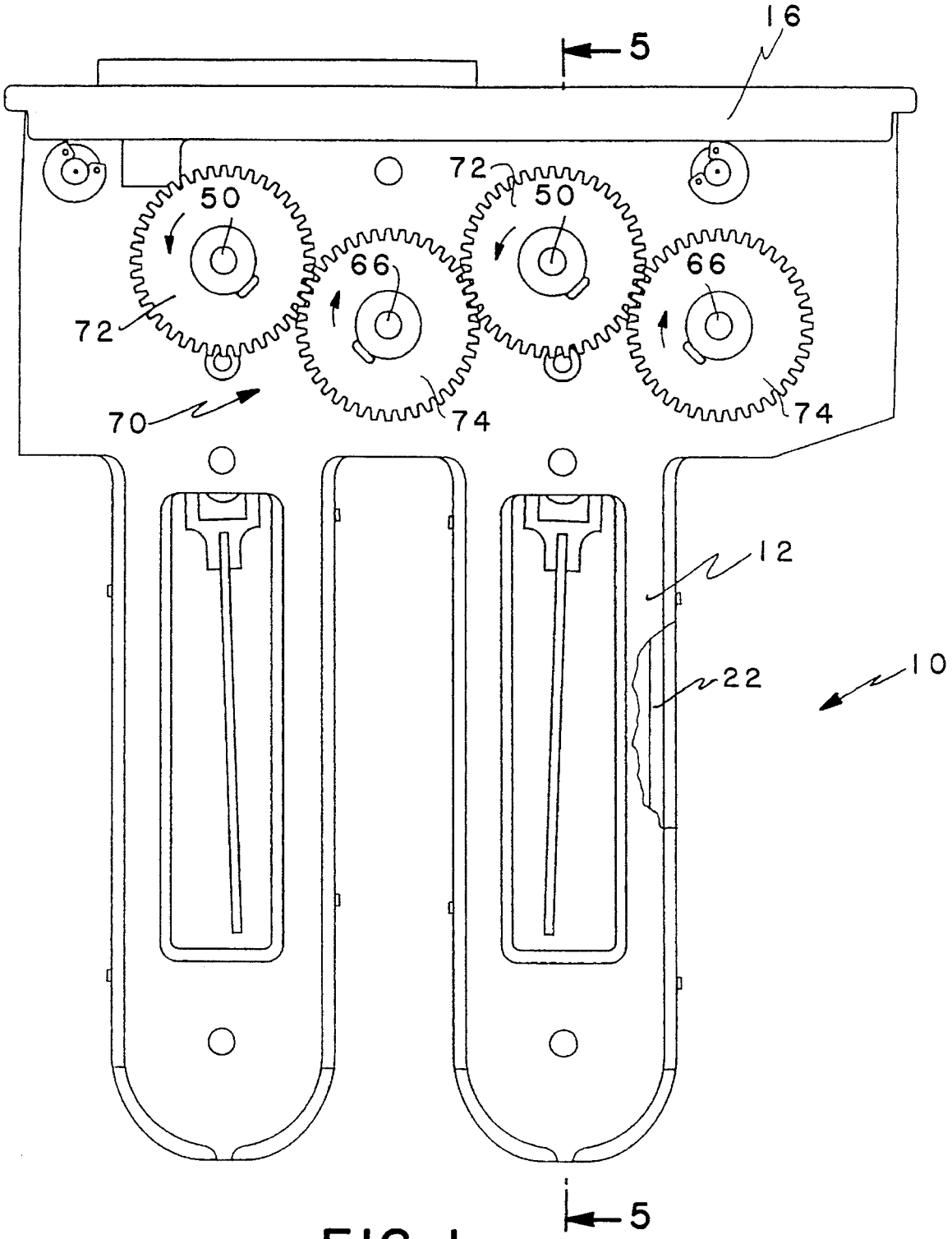
FIG. 1 is an elevational front view of the film transport assembly of the present invention.
Figure 2:
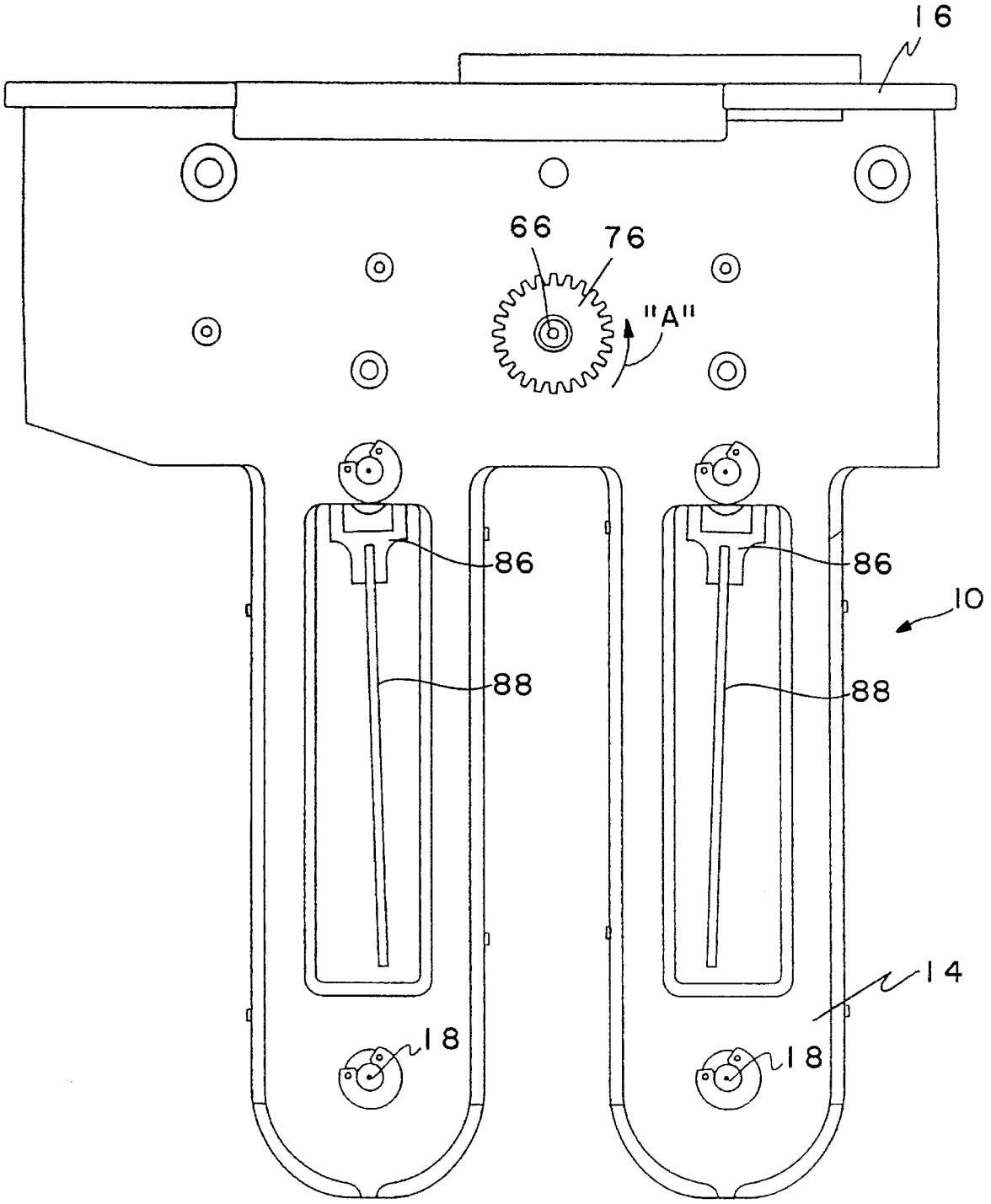
FIG. 2 is a back elevational view of the film processor of FIG. 1.

As shown in FIG. 1, there is mounted a gear train, generally indicated as 70, positioned on the vertical right side member 12 of the film chip transport assembly 10 for rotating the endless belts 56 and the upper lifters 62, as more fully hereinafter described. The gear drive assembly 70 is comprised of gears 72 affixed to shafts 50 for rotating the upper lifters 60 and gears 74 mounted to shafts 66. The gears 70 and 72 are driven by drive motor gear pinion of a drive motor (not shown) engaging a drive gear 76 mounted to shaft 66 referring to FIG. 2.

Vertically disposed beneath the upper drive rollers 46, referring again to FIG. 3, there is positioned a gear member 80 mounted for rotation on a shaft 82 including a circularly-shaped member 84 asymmetrically positioned on the shaft 82. Vertically-disposed beneath the gear member 80, there is provided a stirring member 86 including vertically-disposed paddle portion 88 extending downwardly to a point above the lower semicircular portions 26 and 34. The mixing member 86 is positioned on a cylindrically-shaped member 90 disposed on a shaft 92. An upper portion of the mixing member 86 is formed with upwardly-extending arm members 94 defining a semicircular groove 96 engaging the circularly-shaped member 84 as more fully hereinafter described.

In operation, counterclockwise rotation of the drive gear 74 about the shaft 66 by motor drive assembly (not shown) illustrated by arrow "A" effects rotation of the gears 72 and 74 as illustrated by the arrows in FIG. 1. Rotation of the gears 72 and 74 is continuous with concomitant rotations of the gear members 46 and thus causing coursing of the endless belt members 56 including outwardly-extending pins 60 mounted to the endless belt members 56. As readily understood, the gears 46 are continuously rotated in a clockwise direction (in FIG. 3) thereby effecting clockwise rotation of endless belt members 56 still referring to FIG. 3. The positioning of the upper lifters 64 on the shafts 66 coincide with the position of the pins 60 on the endless belt member 56 and counterclockwise rotation of the upper lifters 64 to effect transfer of a film chip FC from a pin member 60 through the upper semicircular portion 30 to the vertically-extending portion 32 and thence downwardly and about the lower section 34 whereupon the film chip FC is raised in the vertical section 36. Upon reaching the upper semicircular portion 38, a film chip FC is thereupon contacted by the upper lifter 64 in the semicircular portion 38 and caused to be passed therethrough exiting the film transport assembly 10 via the outlet section 40 for further processing as disclosed in the aforementioned issued and pending U.S. Letters Patent.

In operating the clockwise rotation of the gear 46 effects via meshing of teeth 48 thereof with teeth of the gear 80 the counterclockwise rotation of the shaft 82 thereby rotating the member 84 to effect reciprocating movements as illustrated by arm B of the mixing member 86 and thus the paddle member 88. Insertion of the film transport assembly 10 of the present invention into respective tanks of a film processing unit would effect stirring of processing chemicals in any such tanks during operation of the film transport assembly.

While the film transport assembly of the present invention has been illustrated as being formed of two distinct sections of paired vertical portions and cooperating lower semicircular portions, it will be understood by one skilled in the art that a film transport assembly may be formed of more than two of such distinct sections. Still further, an adjustment mechanism may be provided to vary the width permitting processing of film chips of varying width. Additionally, the number of pins may be varied to alter immersion depth.

While the present invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed is:

1. A film chip transport assembly for a film chip processor comprising:

a channel formed by spaced wall members having lower curved portions and upper curved portions; a groove formed in opposing surfaces of said spaced wall members forming a transport path through said channel for a vertically-oriented film chip;

an endless belt member vertically disposed above each lower curved portion and including outwardly-extending pin members extending into said channel;

an upper lifter mounted for rotation about an axis substantially at the center of each upper curved portion of said channel, said upper lifter timed to rotate to a pin member on said endless belt member to transport said film chip through a respective upper curved portion of said channel;

a gear associated with each upper lifter;

a gear associated with each endless belt member;

a power gear coupled to engage said gears: and a stirring assembly including a paddle member vertically-disposed in a space defined by said endless belt member.

2. The film chip transport assembly as defined in claim 1 and further including means for effecting reciprocating movement of said paddle member of said stirring assembly.

3. The film chip transport assembly as defined in claim 2 wherein said means for effecting reciprocating movement of said paddle member includes a gear member for engaging a gear of said gear associated with each endless belt member whereby said stirring assembly is caused to reciprocate about an asymmetrically-mounted cylindrically-shaped bearing member.

* * * * *